US006816597B1

(12) United States Patent
Kawano

(10) Patent No.: US 6,816,597 B1
(45) Date of Patent: Nov. 9, 2004

(54) PSEUDO STEREOPHONIC DEVICE

(75) Inventor: Seiji Kawano, Nishinomiya (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/581,532

(22) PCT Filed: Dec. 28, 1998

(86) PCT No.: PCT/JP98/06011

§ 371 (c)(1),
(2), (4) Date: Aug. 31, 2000

(87) PCT Pub. No.: WO99/35886

PCT Pub. Date: Jul. 15, 1999

(30) Foreign Application Priority Data

Jan. 8, 1998 (JP) ..... 10-002163

(51) Int. Cl.[7] ..... H04R 5/00
(52) U.S. Cl. ..... 381/17

(58) Field of Search ..... 381/1, 17, 18, 381/310, 61, 63

(56) References Cited

FOREIGN PATENT DOCUMENTS

| | | |
|---|---|---|
| JP | 07288896 | 10/1995 |
| JP | 09187100 | 7/1997 |

*Primary Examiner*—Ping Lee
(74) *Attorney, Agent, or Firm*—Arent Fox, PLLC

(57) ABSTRACT

In a pseudo stereophonic device for producing a pseudo stereophonic signal from a monophonic signal, there are provided m delay units connected in series and gradually delaying an input signal S, m FIR digital filters for respectively subjecting output signals $S_k$ (k=1, 2, . . . m) of the delay units to filter processing, and an operating circuit for executing a predetermined operation on the basis of outputs $Y_k$ (k=1, 2, . . . m) of the respective FIR digital filters, to produce pseudo stereophonic signals $L_{OUT}$ and $R_{OUT}$.

4 Claims, 9 Drawing Sheets

PSEUDO STEREOPHONIC DEVICE

TECHNICAL FIELD

The present invention relates generally to a pseudo stereophonic device for producing a pseudo stereophonic signal from a monophonic signal.

BACKGROUND OF THE INVENTION

Examples of a pseudo stereophonic method for producing a pseudo stereophonic signal from a monophonic signal mainly include two methods; a comb filter system and a band division system.

(1) Comb Filter System

FIG. 5 illustrates the configuration of a pseudo stereophonic device employing the comb filter system.

The pseudo stereophonic device employing the comb filter system has the simplest configuration as a pseudo stereophonic device.

An input signal S is fed to a first adder 111 and a second adder 112, and is fed to a delay unit 101. A signal obtained by delaying the signal S in the delay unit 101 is fed to a multiplier 102, where the signal is multiplexed by a predetermined factor. An output of the multiplier 102 is fed to the first adder 111 and the second adder 112.

In the first adder 111, the output signal of the multiplier 102 is added to the input signal S, and the result of the addition is outputted as a pseudo left signal $L_{OUT}$. In the second adder 112, the output signal of the multiplier 102 is subtracted from the input signal S, and the result of the subtraction is outputted as a pseudo right signal $R_{OUT}$.

The longer a delay time allowed to the delay unit 101 is, the more a stereophonic feeling between the two output signals $L_{OUT}$ and $R_{OUT}$ is increased. However, the signal obtained by the delay is heard as an echo. Accordingly, a delay time of several microseconds is generally allowed to the delay unit 101.

If the delay time of the delay unit 101 is several microseconds, however, non-correlation between two channels is insufficient, so that the stereophonic feeling is insufficient. Particularly, the comb filter system is not suitable for two-channel reproduction processing of a multichannel signal using a sound image localization processing technique.

(2) Band Division System

FIG. 6 illustrates the configuration of a pseudo stereophonic device employing the band division system.

An input signal S is delayed by one sampling time period by each of a plurality of delay units $D_1$ to $D_m$ connected in series.

Pairs of multipliers $ML_1$ and $MR_1$ to $ML_{m+1}$ and $MR_{m+1}$ are respectively provided with respect to the input signal S and output signals of the delay units $D_1$ to $D_m$. The input signal S and each of the output signals of the delay units $D_1$ to $D_m$ are inputted to the corresponding pair of multipliers, where they are multiplexed by a factor.

Output signals of the one multipliers $ML_1$ to $ML_{m+1}$ in the pairs of multipliers are added to each other by adders $AL_1$ to $AL_m$, and the result of the addition is outputted as a pseudo left signal $L_{OUT}$. Output signals of the other multipliers $MR_1$ to $MR_{m+1}$ in the pairs of multipliers are added to each other by adders $AR_1$ to $AR_m$, and the result of the addition is outputted as a pseudo right signal $R_{OUT}$.

The delay units $D_1$ to $D_m$, the one multipliers $ML_1$ to $ML_{m+1}$ in the pairs of multipliers, and the adders $AL_1$ to $AL_m$ constitute a first FIR (Finite Impulse Response) digital filter.

The delay units $D_1$ to $D_m$, the other multipliers $MR_1$ to $MR_{m+1}$ in the pairs of multipliers, and the adders $AR_1$ to $AR_m$ constitute a second FIR digital filter. The delay units $D_1$ to $D_m$ are shared between the first FIR digital filter and the second FIR digital filter.

The filter characteristics of the first FIR digital filter are shown in FIG. 7, and the filter characteristics of the second FIR digital filter are shown in FIG. 8. As can be seen from FIGS. 7 and 8, the filter characteristics of each of the FIR digital filters are such characteristics that a frequency band is divided into a plurality of pass and stop bands, and the pass bands and the stop bands alternately appear. The filter characteristics are such characteristics that the pass and stop bands in the first FIR digital filter and the pass and stop bands in the second FIR digital filter are opposite to each other such that the respective filter outputs $L_{OUT}$ and $R_{OUT}$ are not correlated with each other.

In the pseudo stereophonic device employing the band division system, if each of the pass and stop bands in each of the FIR digital filters is wide, the FIR digital filter may be only composed of hundreds of taps. However, sound is offset for each wide frequency band, so that an unnatural tone color is obtained. On the other hand, if each of the pass and stop bands in each of the FIR digital filters is narrowed, non-correlation is improved, so that a natural tone color is obtained. However, the FIR digital filter must be composed of not less than thousands of taps, so that a huge amount of processing is required.

As described above, in the pseudo stereophonic device employing the comb filter system, the processing is light, while sufficient non-correlation (stereophony) cannot be performed. In the pseudo stereophonic device employing the band division system, a huge amount of processing is required to perform sufficient non-correlation.

An object of the present invention is to provide a pseudo stereophonic device in which sufficient non-correlation can be performed, and a huge amount of processing is not required.

DISCLOSURE OF INVENTION

In a pseudo stereophonic device for producing a pseudo stereophonic signal from a monophonic signal, a first pseudo stereophonic device according to the present invention is characterized by comprising m delay units connected in series and gradually delaying an input signal S, m FIR digital filters for respectively subjecting output signals $S_k$ (k=1, 2, . . . m) of the delay units to filter processing, and an operating circuit for executing, letting $Y_k$ (k=1, 2, . . . m) be outputs of the respective FIR digital filters, an operation expressed by the following equation (1), to produce pseudo stereophonic signals $L_{OUT}$ and $R_{OUT}$:

$$L_{OUT} = Y_1 + \sum_{k=2}^{m} Y_k \qquad (1)$$

$$R_{OUT} = Y_1 - \sum_{k=2}^{m} Y_k$$

The delay unit in the first row may be omitted, and the input signal S may be inputted to the FIR digital filter in the first row and the delay unit in the second row.

Letting $n_k$ be the number of taps composing the FIR digital filter in the k-th row, it is preferable that a filter factor of each of the FIR digital filters satisfies the condition expressed by the following equation (2):

$$W_{k,i}=W_{m-k+2,n_m-j+1} \quad \text{(b).}$$

A second pseudo stereophonic device according to the present invention is a pseudo stereophonic device equivalent to the first pseudo stereophonic device satisfying the foregoing equation (2), characterized in that one multiplier is shared between two multipliers, respectively having equal filter factors, in the different FIR digital filters.

BEST MODE FOR CARRYING OUT THE INVENTION

Referring now to FIGS. 1 to 4, embodiments of the present invention will be described.

[1] Description of First Embodiment

Figure 1A:
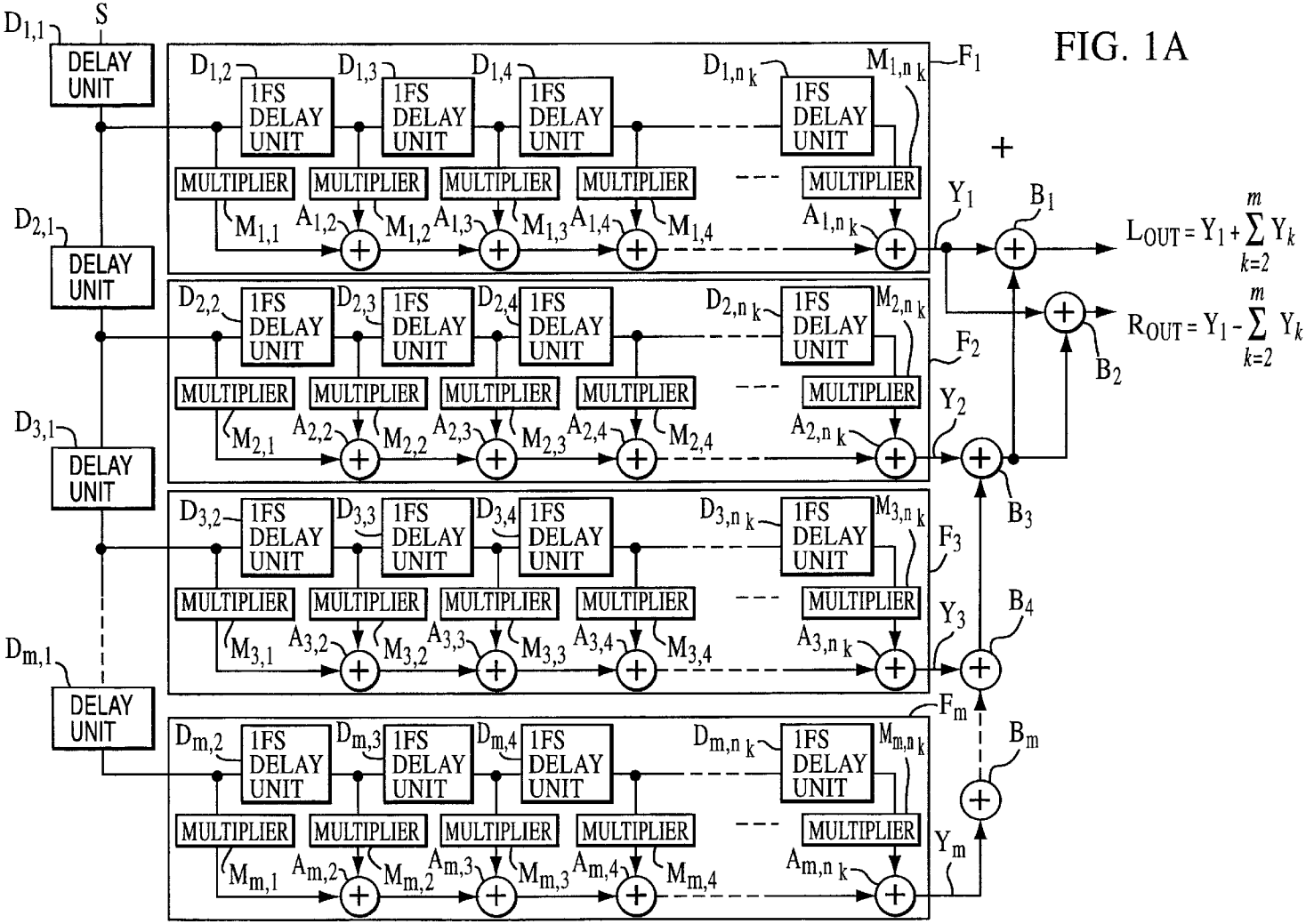
FIG. 1A is a circuit diagram showing the configuration of a pseudo stereophonic device according to a first embodiment of the present invention.

FIG. 1A illustrates the configuration of a pseudo stereophonic device.

The pseudo stereophonic device has a hybrid configuration comprising a combination of a comb filter system and FIR digital filters.

A monophonic input signal S is delayed by a predetermined time period by each of a plurality of delay units $D_{k,1}$ (k=1, 2, . . . m) (where m is an odd number) connected in series.

Output signals of the delay units $D_{1,1}$ to $D_{m,1}$ are respectively fed to FIR digital filters $F_k$ (k=1, 2, . . . m), where they are subjected to filter processing.

Each of the FIR digital filters $F_1$ to $F_m$ is constituted by a plurality of delay units whose delay time is one sampling time period, a plurality of multipliers, and a plurality of adders, as is well known.

The delay units are respectively indicated by $D_{k,j}$ (k=1, 2, . . . m:j=2, 3, . . . $n_k$). The multipliers are respectively indicated by $M_{k,j}$ (k=1, 2, . . . m:j=1, 2, . . . $n_k$). The adders are respectively indicated by $A_{k,j}$ (k=1, 2, . . . m:j=2, 3, . . . $n_k$) $n_k$ indicates the number of taps composing the FIR digital filter in the k row.

The FIR digital filters $F_1$ to $F_m$ respectively have filter factors $W_{kj}$ (k=1, 2, . . . m:j=1, 2, . . . $n_k$) indicated by the multipliers $M_{kj}$ (k=1, 2, . . . M:j=1, 2, . . . $n_k$) included therein.

The results of the filter processing by the FIR digital filters $F_1$ to $F_m$ are respectively taken as $Y_k$ ( k=1, 2, . . . m).

The results of the filter processing $Y_k$ (k=2, 3, . . . m) by the FIR digital filters $F_2$ to $F_m$ other than the FIR digital filter $F_1$ in the first row are added to each other by the plurality of adders $B_3$ to $B_m$, and the result of the addition is outputted from the adder $B_3$. The adder $B_1$ adds the output of the adder $B_3$ and the result of the filter processing $Y_1$ by the FIR digital filter $F_1$ in the first row to each other, and outputs the result of the addition as a pseudo left signal $L_{OUT}$.

The adder $B_2$ subtracts the output of the adder $B_3$ from the result of the filter processing $Y_1$ by the FIR digital filter $F_1$ in the first row, and outputs the result of the subtraction as a pseudo right signal $R_{OUT}$.

The pseudo left signal $L_{OUT}$ and the pseudo right signal $R_{OUT}$ which are thus obtained are pseudo stereophonic signals. The pseudo stereophonic signal $L_{OUT}$ and the pseudo stereophonic signal $R_{OUT}$ are expressed by the following equation (3):

$$L_{OUT} = Y_1 + \sum_{k=2}^{m} Y_k \quad (3)$$

$$R_{OUT} = Y_1 - \sum_{k=2}^{m} Y_k$$

In the pseudo stereophonic device, non-correlation processing in the comb filter system in which processing is light can be made the most of, and the FIR digital filters are employed only in a portion where the non-correlation by the comb filter system is insufficient. Accordingly, the number of taps composing the FIR digital filter can be significantly made smaller, as compared with the number of taps composing the FIR digital filter employed in the band division system.

Figure 1B:
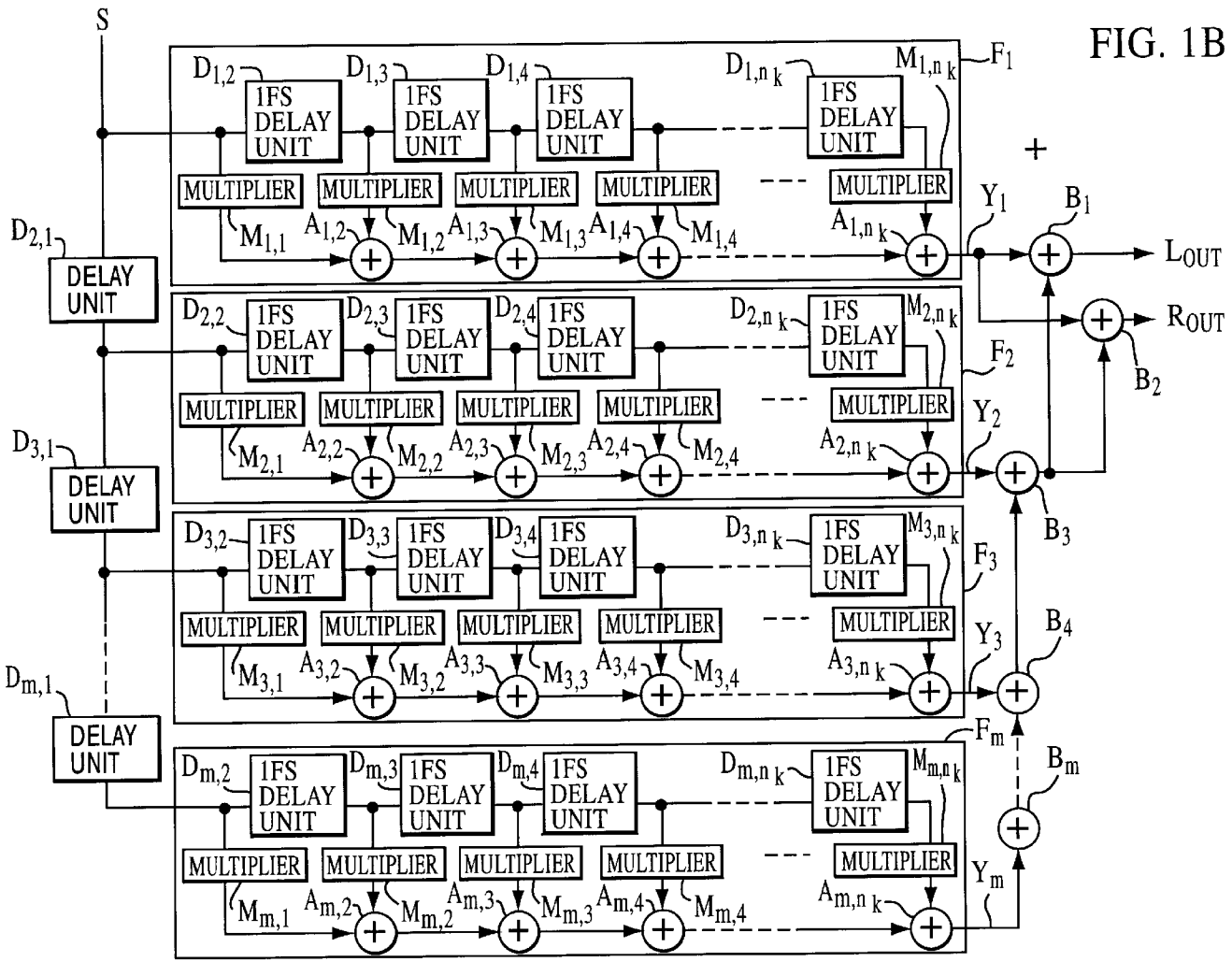
FIG. 1B is a circuit diagram showing the configuration of a pseudo stereophonic device according to an alternate embodiment of the present invention.

FIG. 1B is a circuit diagram showing the configuration of a pseudo stereophonic device according to an alternate embodiment of the present invention. FIG. 1B is similar to the circuit diagram of FIG. 1A. However, in the circuit diagram of FIG. 1B, the delay unit $D_{1,1}$ in the first row of FIG. 1A is omitted, and the input signal S is inputted to the FIR digital filter $F_1$ in the first row and the delay unit $D_{2,1}$ in the second row.

[2] Description of Second Embodiment

Figure 2:
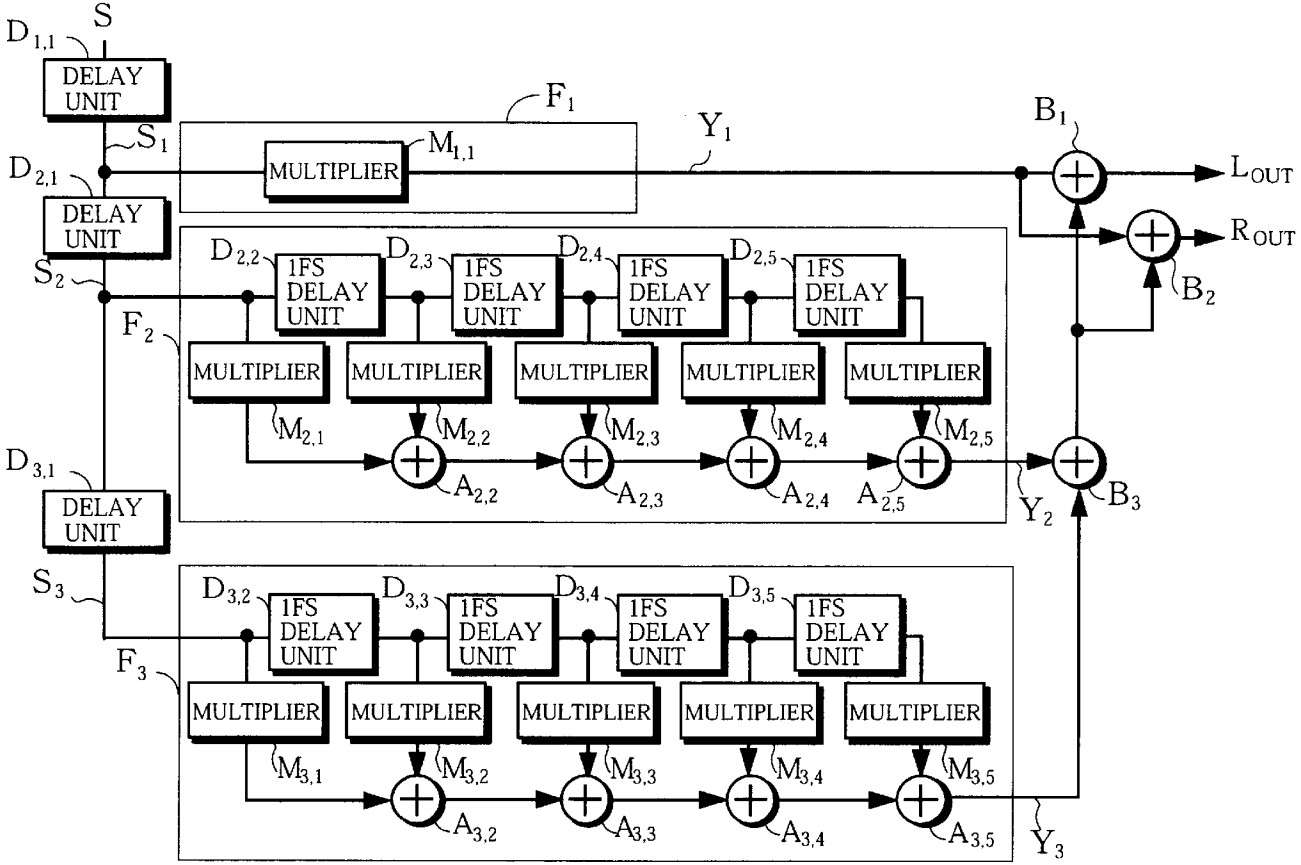
FIG. 2 is a circuit diagram showing the configuration of a pseudo stereophonic device according to a second embodiment of the present invention.

FIG. 2 illustrates the configuration of a pseudo stereophonic device.

The pseudo stereophonic device corresponds to a case where m=3, $n_1$=1, $n_2$=$n_3$=5 in the pseudo stereophonic device shown in FIG. 1.

A monophonic input signal S is delayed by a predetermined time period by each of a plurality of three delay units $D_{1,1}$, $D_{2,1}$, and $D_{3,1}$ connected in series. Signals obtained by delaying the signal S in the delay units $D_{1,1}$, $D_{2,1}$, and $D_{3,1}$ are respectively taken as $S_1$, $S_2$, and $S_3$.

The output signal $S_1$ of the delay unit $D_{1,1}$ is fed to a first FIR digital filter $F_1$. The output signal $S_2$ of the delay unit $D_{2,1}$ is fed to a second FIR digital filter $F_2$. The output signal $S_3$ of the delay unit $D_{3,1}$ is fed to a third FIR digital filter $F_3$.

The first FIR digital filter $F_1$ is constituted by one multiplier $M_{1,1}$. That is, the first FIR digital filter $F_1$ is an FIR digital filter composed of one tap.

The second FIR digital filter $F_2$ is constituted by four delay units $D_{2,2}$ to $D_{2,5}$ whose delay time is one sampling time period, five multipliers $M_{2,1}$ to $M_{2,5}$, and four adders $A_{2,2}$ to $A_{2,5}$. That is, the second FIR digital filter $F_2$ is an FIR digital filter composed of five taps respectively having filter factors $W_{2,1}$ to $W_{2,5}$ indicated by the multipliers $M_{2,1}$ to $M_{2,5}$.

The third FIR digital filter $F_3$ is constituted by four delay units $D_{3,2}$ to $D_{3,5}$ whose delay time is one sampling time period, five multipliers $M_{3,1}$ to $M_{3,5}$ and four adders $A_{3,2}$ to $A_{3,5}$. That is, the third FIR digital filter $F_3$ is an FIR digital filter composed of five taps respectively having filter factors $W_{3,1}$ to $W_{3,5}$ indicated by the multipliers $M_{3,1}$ to $W_{3,5}$.

The result of filter processing $Y_2$ by the second FIR digital filter $F_2$ and the result of filter processing $Y_3$ by the third FIR digital filter $F_3$ are added to each other by an adder $B_3$.

An adder $B_1$ adds the result of filter processing $Y_1$ by the first FIR digital filter $F_1$ and the result of the addition $(Y_2+Y_3)$ by the adder $B_3$ to each other, and outputs the result of the addition as a pseudo left signal $L_{OUT}$.

An adder $B_2$ subtracts the result of the addition $(Y_2+Y_3)$ by the adder $B_3$ from the result of filter processing $Y_1$ by the first FIR digital filter $F_1$, and outputs the result of the subtraction as a pseudo right signal $R_{OUT}$.

Consequently, the pseudo stereophonic signals $L_{OUT}$ and $R_{OUT}$ are expressed by the following equation (4):

$$L_{OUT}=Y_1+Y_2+Y_3$$
$$R_{OUT}=Y_1-Y_2-Y_3 \quad (4)$$

Considering that $Y_1$, $Y_2$, and $Y_3$ are common between $L_{OUT}$ and $R_{OUT}$, a pseudo stereophonic device can be substantially realized in an amount of processing performed by an FIR digital filter composed of approximately 10 taps. It is found that the pseudo stereophonic device in the above-mentioned embodiment is significantly decreased in the amount of processing, as compared with a pseudo stereophonic device employing a band division system which requires processing performed by an FIR digital filter composed of not less than thousands of taps. The acoustic effect is approximately the same as that in the pseudo stereophonic device employing the band division system.

[3] Description of Third Embodiment

It is preferable that in the second embodiment, the factors (filter factors) of the respective multipliers $M_{2,1}$ to $M_{2,5}$ in the second FIR digital filter $F_2$ and the factors (filter factors) of the respective multipliers $M_{3,1}$ to $M_{3,5}$ in the third FIR digital filter $F_3$ have the following relationships:

Factor of Multiplier $M_{2,1}$=Factor of Multiplier $M_{3,5}$
Factor of Multiplier $M_{2,2}$=Factor of Multiplier $M_{3,4}$
Factor of Multiplier $M_{2,3}$=Factor of Multiplier $M_{3,3}$
Factor of Multiplier $M_{2,4}$=Factor of Multiplier $M_{3,2}$
Factor of Multiplier $M_{2,5}$=Factor of Multiplier $M_{3,1}$ The following are specific examples:

Delay time of Delay unit $D_{1,1}$: 7.48 [msec]
Delay time of Delay unit $D_{2,1}$: 11.54 [msec]
Delay time of Delay unit $D_{3,1}$: 27.32 [msec]
Factors of Multipliers $M_{2,1}$,$M_{3,5}$: 5.35406805574894e-2
Factors of Multipliers $M_{2,2}$, $M_{3,4}$: 1.596434861421585e-1
Factors of Multipliers $M_{2,3}$, $M_{3,3}$: 2.495117336511612e-1
Factors of Multipliers $M_{2,4}$, $M_{3,2}$: −f1.586669087409973e-1
Factors of Multipliers $M_{2,5}$, $M_{3,1}$: −5.25641143321991e-2

The above-mentioned relationships of the filter factors among the FIR digital filters are expressed by the following general equation:

Letting $n_k$ be the number of taps composing an FIR digital filter in the k-th row and $M_{k,j}$ be the multipliers in the FIR digital filters $F_2$ to $F_m$ (k=2, 3, . . . m;j=1, 2, . . . $n_k$), a factor W (k,j) of each of the multipliers $M_{k,j}$ (a filter factor for the j-th tap ($1 \leqq j \leqq n_k$) in the FIR digital filter in the k-th row ($2 \leqq k \leqq m$)) may be set so as to satisfy the condition expressed by the following equation (5):

$$W_{k,j}=W_{m-k+2,n_m-j+1} \quad (5)$$

Figure 3:
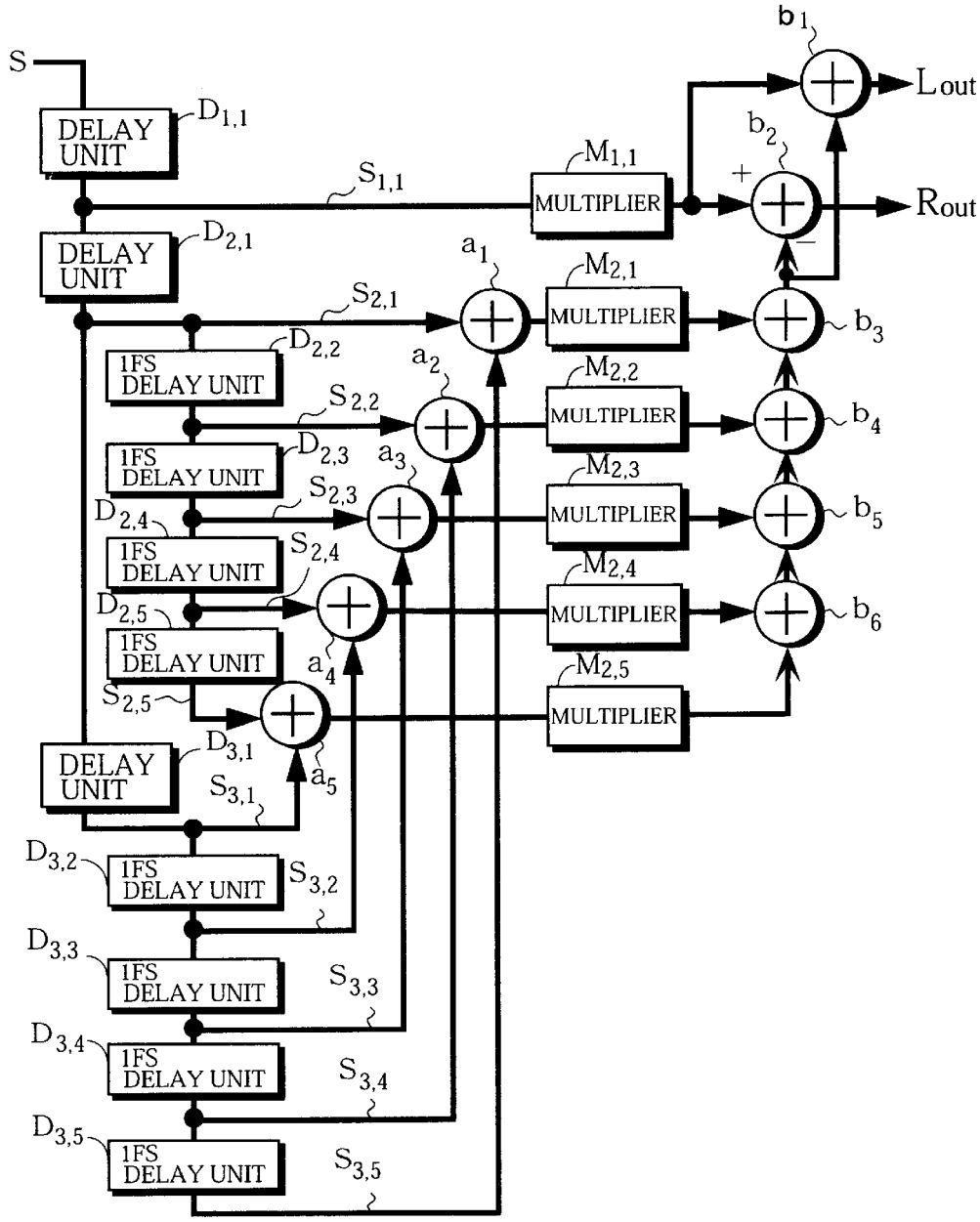
FIG. 3 is a circuit diagram showing the configuration of a pseudo stereophonic device according to a third embodiment of the present invention.

In the pseudo stereophonic device shown in FIG. 2, when the filter factors are set so as to satisfy the condition expressed by the foregoing equation (5), the pseudo stereophonic device shown in FIG. 2 can be replaced with an equivalent circuit as shown in FIG. 3. In FIG. 3, portions corresponding to those shown in FIG. 2 are assigned the same reference numerals.

In the equivalent circuit, multipliers $M_{2,1}$ to $M_{2,5}$ shown in FIG. 3 are shared between the multipliers $M_{2,1}$ to $M_{2,5}$ and the multipliers $M_{3,5}$ to $M_{3,1}$, which respectively have the same factors, in the second FIR digital filter $F_2$ and the third FIR digital filter $F_3$ shown in FIG. 2.

The result of addition of an output $S_{2,1}$ of a delay unit $D_{2,1}$ and an output $S_{3,5}$ of a delay unit $D_{3,5}$ by an adder $a_1$ is fed to the multiplier $M_{2,1}$. The result of addition of an output $S_{2,2}$ of a delay unit $D_{2,2}$ and an output $S_{3,4}$ of a delay unit $D_{3,4}$ by an adder $a_2$ is fed to the multiplier $M_{2,2}$.

The result of addition of an output $S_{2,3}$ of a delay unit $D_{2,3}$ and an output $S_{3,3}$ of a delay unit $D_{3,3}$ by an adder $a_3$ is fed to the multiplier $M_{2,3}$. The result of addition of an output $S_{2,4}$ of a delay unit $D_{2,4}$ and an output $S_{3,2}$ of a delay unit $D_{3,2}$ by an adder $a_4$ is fed to the multiplier $M_{2,4}$. The result of addition of an output $S_{2,5}$ of a delay unit $D_{2,5}$ and an output $S_{3,1}$ of a delay unit $D_{3,1}$ by an adder $a_5$ is fed to the multiplier $M_{2,5}$.

Outputs of the multipliers $M_{2,1}$, $M_{2,2}$, $M_{2,3}$, $M_{2,4}$, and $M_{2,5}$ are added to each other by adders $b_3$ to $b_6$, and the result of the addition is outputted from the adder $b_3$. An adder $b_1$ adds an output $Y_1$ of the multiplier $M_{1,1}$ and the output of the adder $b_3$ to each other, and outputs the result of the addition as a pseudo left signal $L_{OUT}$. An adder $b_2$ subtracts the output of the adder $b_3$ from the output $Y_1$ of the multiplier $M_{1,1}$ and outputs the result of the subtraction as a pseudo right signal $R_{OUT}$.

Letting $S_{k,j}$ (k=2, 3, . . . m:j=1, 2, . . . $n_k$) be outputs of delay units $D_{k,j}$ (k=2, 3, . . . m:j=1, 2, . . . $n_k$), respectively, the pseudo stereophonic signals $L_{OUT}$ and $R_{OUT}$ are expressed by the following equation (6):

$$L_{OUT} = Y_1 + \sum_{k=2}^{3} \sum_{j=1}^{5} W_{k,j}(S_{k,j} + S_{5-k,6-j}) \quad (6)$$

$$R_{OUT} = Y_1 - \sum_{k=2}^{3} \sum_{j=1}^{5} W_{k,j}(S_{k,j} + S_{5-k,6-j})$$

According to the third embodiment, the number of operations can be made smaller, as compared with that in the above-mentioned second embodiment.

[4] Description of Applied Example

Figure 4:
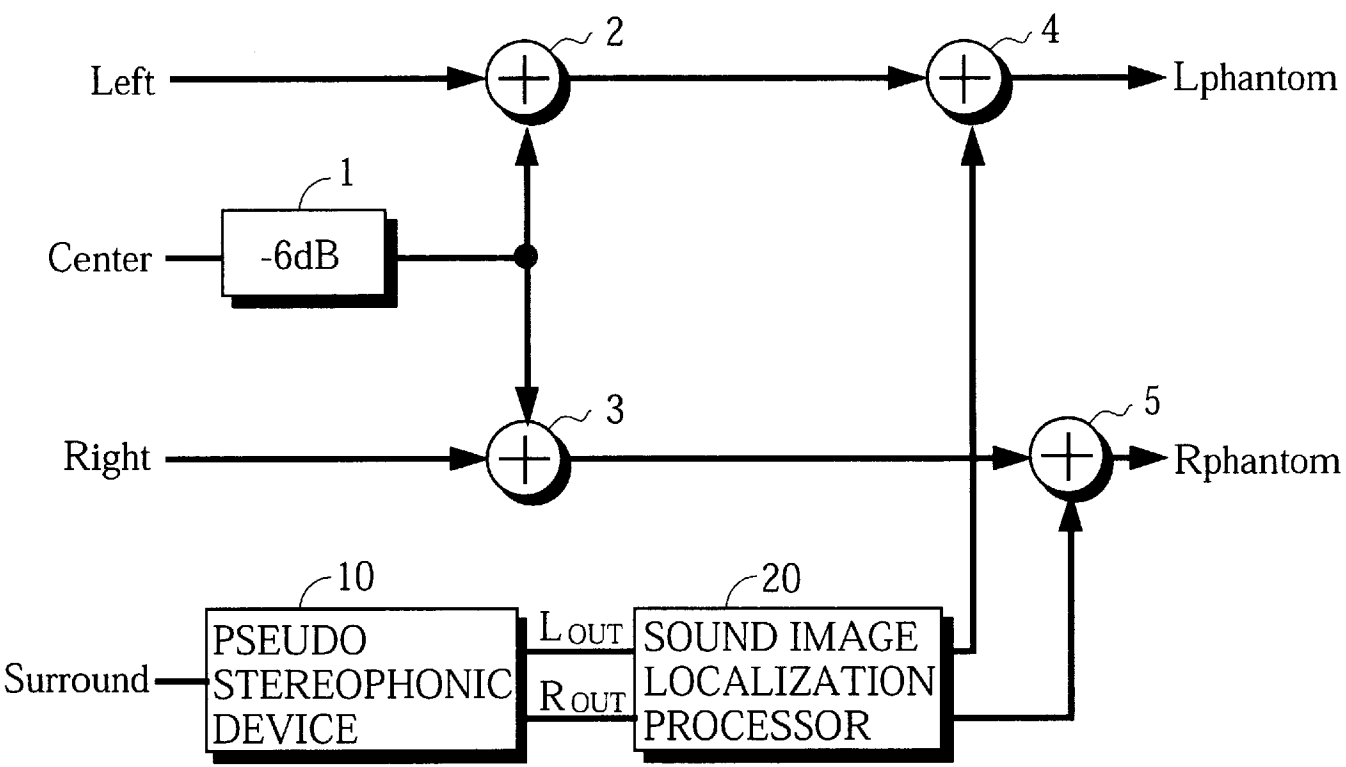
FIG. 4 is a block diagram showing an applied example.
Figure 5:
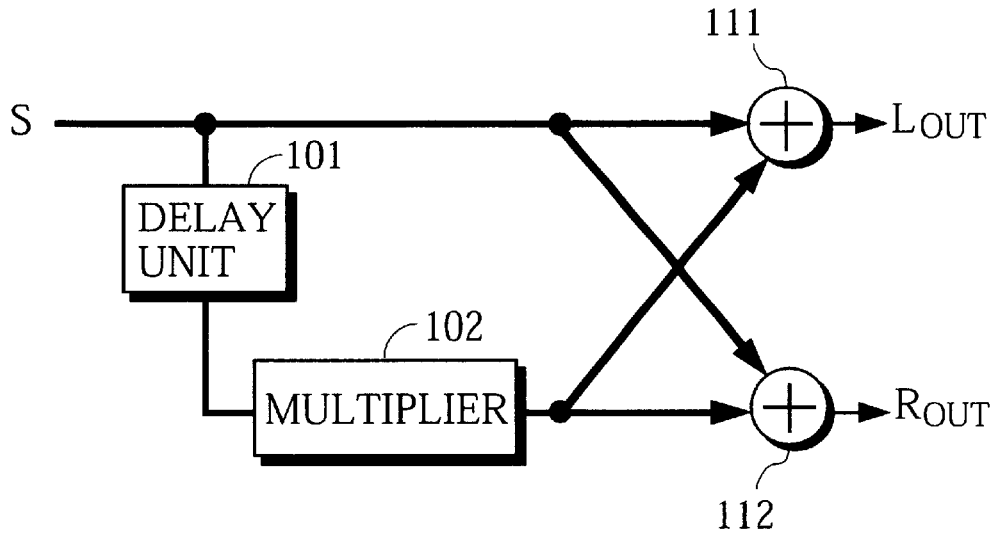
FIG. 5 is a circuit diagram showing the configuration of a pseudo stereophonic device employing a comb filter system.
Figure 6:
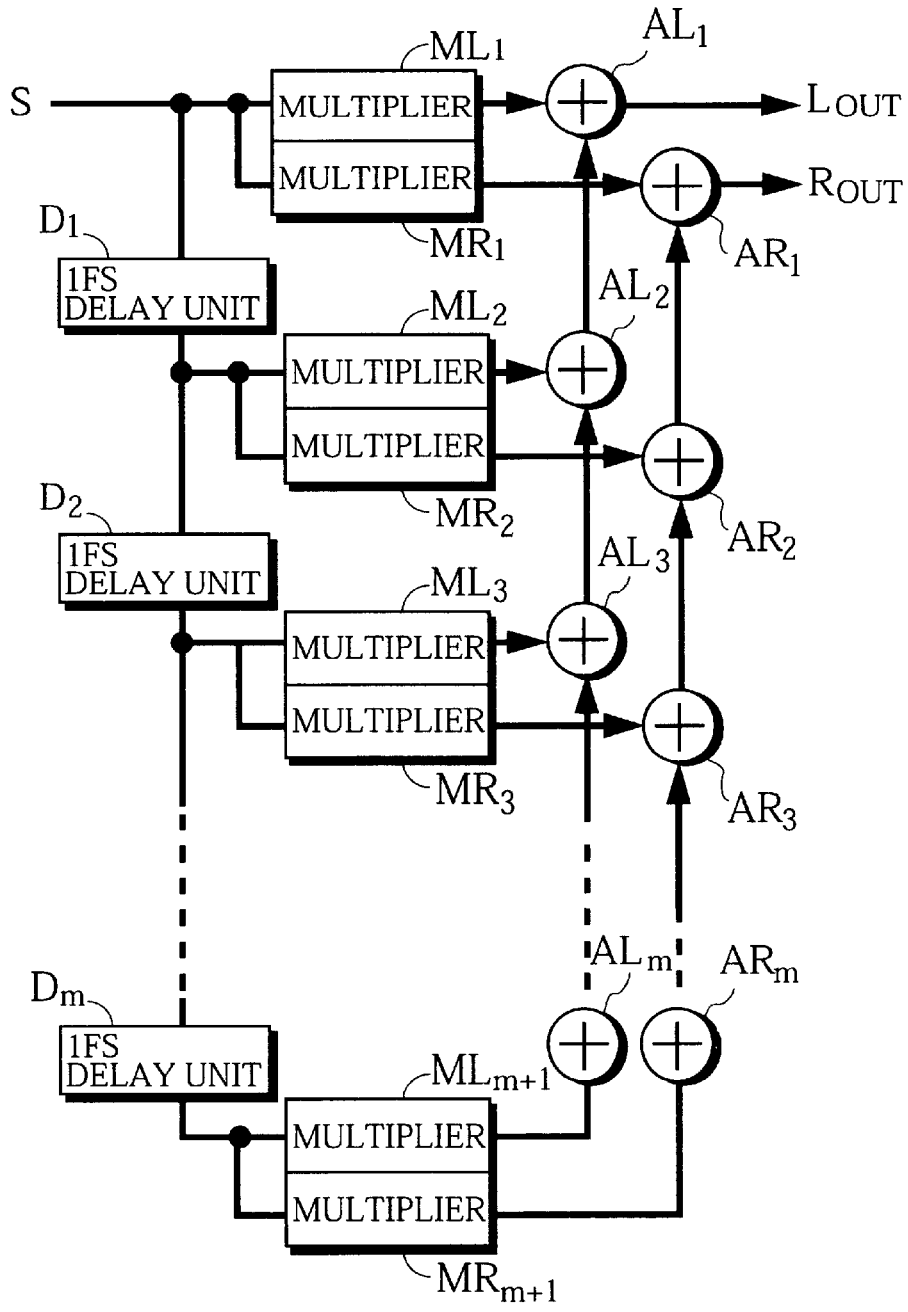
FIG. 6 is a circuit diagram showing the configuration of a pseudo stereophonic device employing a band division system.
Figure 7:
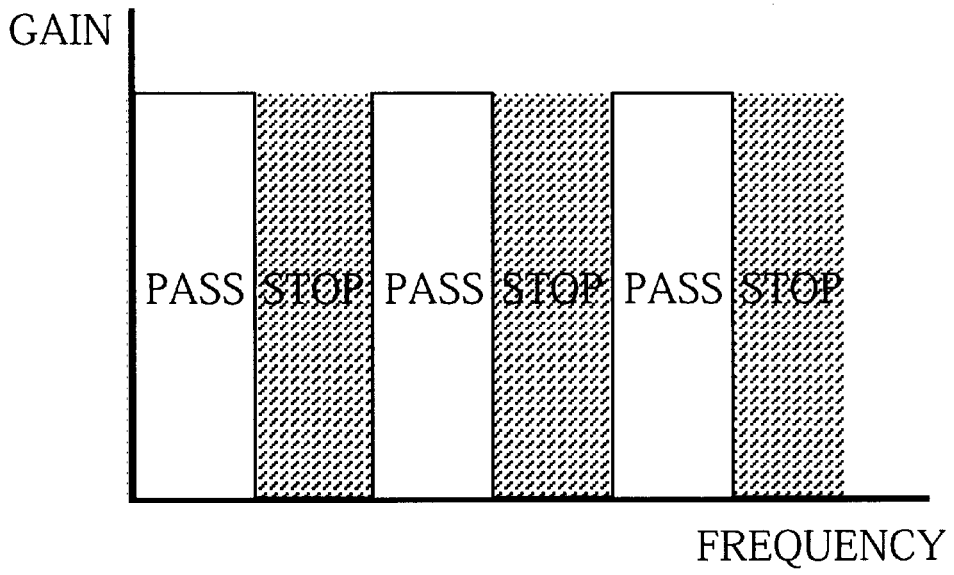
FIG. 7 is a characteristic view showing filter characteristics of a first FIR digital filter in the pseudo stereophonic device employing the band division system shown in FIG. 6.
Figure 8:
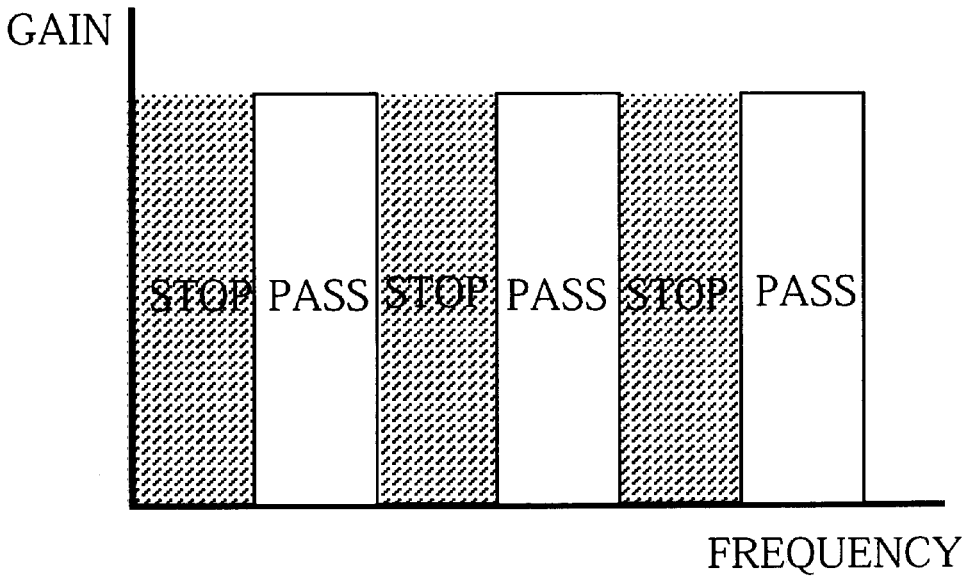
FIG. 8 is a characteristic view showing filter characteristics of a second FIR digital filter in the pseudo stereophonic device employing the band division system shown in FIG. 6.

FIG. 4 illustrates an example in which the pseudo stereophonic device shown in FIGS. 1A, 1B, 2, or 3 is applied to such an acoustic device that a signal having three-channel (Left, Center, Right) signals at the front and a single-channel (Surround) signal at the rear, for example, a four-channel signal obtained by decoding a Dolby prologic looks as if it was outputted from a total of four speakers, i.e., right and left speakers and right and left speakers respectively arranged ahead of and behind a listener, although it was outputted from two speakers (a left speaker and a right speaker) arranged ahead of the listener.

The single-channel surround signal is inputted to the pseudo stereophonic device 10 shown in FIGS. 1A, 1B, 2, or 3. The pseudo stereophonic device 10 produces a pseudo surround left signal $L_{OUT}$ and a pseudo surround right signal $R_{OUT}$ from the single-channel surround signal.

The pseudo surround left signal $L_{OUT}$ and the pseudo surround right signal $R_{OUT}$ are fed to a sound image localization processor 20. The sound image localization processor 20 subjects the inputted signals $L_{OUT}$ and $R_{OUT}$ to sound image localization processing such that the inputted signals $L_{OUT}$ and $R_{OUT}$ are localized at the left rear and the right rear of the listener.

On the other hand, an adder 2 adds the left signal Left to a signal obtained by subjecting the center signal Center to gain control of −6 dB in a multiplier 1. Further, an adder 3 adds the right signal Right to a signal obtained by subjecting the center signal Center to gain control of −6 dB in the multiplier 1.

An output of the adder 2 and a surround left signal $L_{OUT}$ after the localization processing which is outputted from the sound image localization processor 20 are added to each other by an adder 4, and the result of the addition is taken as an output Lphantom to the left speaker. An output of the adder 3 and a surround right signal $R_{OUT}$ after the localization processing which is outputted from the sound image localization processor 20 are added to each other by an adder 5, and the result of the addition is taken as an output Rphantom to the right speaker.

What is claimed is:

1. A pseudo stereophonic device for producing a pseudo stereophonic signal from a monophonic signal, comprising:

m delay devices connected in series and gradually delaying an input signal S;

m FIR digital filters for respectively subjecting output signals $S_k$ (k=1, 2, . . . m) of the delay devices to filter processing; and an operating circuit for executing, letting $Y_k$ (k=1, 2, . . . m) be outputs of the respective FIR digital filters, an operation expressed by the following equation (a), to produce pseudo stereophonic signals $L_{OUT}$ and $R_{OUT}$:

$$L_{OUT} = Y_1 + \sum_{k=2}^{m} Y_k \qquad \text{(a)}$$

$$R_{OUT} = Y_1 - \sum_{k=2}^{m} Y_k$$

wherein m is an integer greater than or equal to 2.

2. A pseudo stereophonic device for producing a pseudo stereophonic signal from a monophonic signal, comprising:

m delay devices connected in series and gradually delaying an input signal S;

m FIR digital filters for respectively subjecting output signals $S_k$ (k=1, 2, . . . m) of the delay devices to filter processing; and an operating circuit for executing, letting $Y_k$ (k=1, 2, . . . m) be outputs of the respective FIR digital filters, an operation expressed by the following equation (a), to produce pseudo stereophonic signals $L_{out}$ and $R_{OUT}$;

$$L_{OUT} = Y_1 + \sum_{k=2}^{m} Y_k \qquad \text{(a)}$$

$$R_{OUT} = Y_1 - \sum_{k=2}^{m} Y_k$$

wherein m is an integer greater than or equal to 2; a first delay device of said m delay devices is omitted such that the total number of delay devices is m−1, and the input signal S is input to a first FIR digital filter of said m FIR digital filters and a second delay device of said m delay devices.

3. The pseudo stereophonic device according to either one of claims 1 and 2, wherein letting $n_k$ be the number of taps composing an FIR digital filter in a k-th row ($2 \leqq k \leqq m$) out of the m FIR digital filters, a j-th tap ($1 \leqq j \leqq n_k$) in the FIR digital filter in the k-th row has a filter factor W (k,j), which satisfies the condition expressed by the following equation (b):

$$W_{k,j} = W_{m-k+2,n_m-j+1} \qquad \text{(b).}$$

4. A pseudo stereophonic device equivalent to the pseudo stereophonic device according to claim 3, wherein one multiplier is shared between two multipliers, respectively having equal filter factors, in the different FIR digital filters.

* * * * *